US008128009B2

(12) United States Patent
Shingu et al.

(10) Patent No.: US 8,128,009 B2
(45) Date of Patent: Mar. 6, 2012

(54) FUEL INJECTION VALVE

(75) Inventors: Akio Shingu, Chiyoda-ku (JP); Masayuki Aota, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 319 days.

(21) Appl. No.: 12/273,335

(22) Filed: Nov. 18, 2008

(65) Prior Publication Data

US 2009/0289131 A1 Nov. 26, 2009

(30) Foreign Application Priority Data

May 22, 2008 (JP) ..... 2008-134535

(51) Int. Cl.
*B05B 1/30* (2006.01)

(52) U.S. Cl. ..... 239/585.1; 239/585.3; 239/585.4; 239/585.5

(58) Field of Classification Search .... 239/585.1–585.5, 239/533.9, 584, 533.2; 251/129.15, 129.21, 251/127

See application file for complete search history.

(56) References Cited

U.S. PATENT DOCUMENTS

| | | | | | |
|---|---|---|---|---|---|
| 4,129,255 | A * | 12/1978 | Bader et al. | ..... | 239/96 |
| 4,392,612 | A * | 7/1983 | Deckard et al. | ..... | 239/88 |
| 5,544,816 | A * | 8/1996 | Nally et al. | ..... | 239/585.5 |
| 5,673,669 | A * | 10/1997 | Maley et al. | ..... | 123/446 |
| 6,405,947 | B2 * | 6/2002 | Fochtman | ..... | 239/585.4 |
| 6,695,233 | B2 * | 2/2004 | Sekine et al. | ..... | 239/585.1 |
| 7,866,301 | B2 * | 1/2011 | Venkataraghavan et al. | . | 123/472 |
| 2009/0140080 | A1 * | 6/2009 | Howey | ..... | 239/585.5 |

FOREIGN PATENT DOCUMENTS

| | | |
|---|---|---|
| JP | 10339201 | 12/1998 |
| JP | 11-107882 | 4/1999 |
| JP | 2002-506502 | 2/2002 |
| JP | 2003-512557 | 4/2003 |
| JP | 2006-17101 | 1/2006 |
| JP | 2008280876 | 11/2008 |
| WO | 01/29402 A1 | 4/2001 |
| WO | 0129402 A1 | 4/2001 |

* cited by examiner

*Primary Examiner* — Davis Hwu
(74) *Attorney, Agent, or Firm* — Sughrue Mion, PLLC

(57) ABSTRACT

The objective of the present invention is to realize the structure, of a fuel injection valve, in which bouncing of the needle can be suppressed and the armature position can be fixed while the valve is closed, without increasing the number of components and the number of processes. In a fuel injection valve including an armature that is repelled or attracted by a core, by de-energizing or energizing a coil; a needle that opens or closes a valve seat in accordance with a reciprocal travel of the armature; and a valve-closing spring that biases the needle so as to close the valve, when the coil is de-energized, the needle and the armature are fixed in such a way that the armature can travel in an axis direction by a predetermined amount with respect to the needle, and the coil is preliminarily energized while the fuel injection valve is closed by the needle.

2 Claims, 4 Drawing Sheets

FUEL INJECTION VALVE

BACKGROUND OF THE INVENTION

1. Field of the Invention

The present invention relates to a fuel injection valve for an internal combustion engine and particularly to improvement of an electromagnetic fuel injection valve utilized in a fuel supply system in an internal combustion engine.

2. Description of the Related Art

The typical configuration of a fuel injection valve of this kind will be explained with reference to FIG. 1. As illustrated in FIG. 1, a fuel injection valve 1 is configured mainly with a solenoid device 2 and a valve device 12. The solenoid device 2 is configured with a housing 3 that is a yoke portion of a magnetic circuit, a core 4 that is a fixed iron core portion of the magnetic circuit, a coil 5 energized from outside via a connector 6, an armature 7 that is a moving iron core portion of the magnetic circuit, and a valve-closing spring 9 that biases a needle 8 coupled with the armature 7 downstream. In addition, a fuel is supplied through a fuel inlet 10 situated at the upper portion of the fuel injection valve 1, and injected through a valve seat 15; the side of the fuel inlet 10 is referred to as "an upstream side", and the side of the valve seat 15 referred to as "a downstream side".

In contrast, the valve device 12 is configured with a hollow body 13 that is coupled with the housing 3 and contains part of the core 4 and the armature 7, the needle 8 that is disposed inside the body 13 and coupled with the armature 7, a guide 14 that is provided at the downstream side of the body 13 and guides the slide of the needle 8, and the valve seat 15 that controls a fuel flow by detaching or attaching the needle 8 thereby opening or closing an injection nozzle 15A. The operation of the foregoing fuel injection valve 1 is well known; thus, the explanation therefor will be omitted.

The detail of the configuration of the conventional fuel injection valve 1 will be explained below with reference to FIGS. 4 to 6 each of which is a partial enlarged view of the solenoid device 2 and the valve device 12. In the typical conventional fuel injection valve 1, as illustrated in FIG. 4, the armature 7 and the needle 8 are integrated by means of welding, press fitting, or the like; the armature 7 is pressed downstream by the valve-closing spring 9. However, as described above, the typical conventional fuel injection valve 1 employs an electromagnet-driving method in which the coil 5 is energized; therefore, due to energization or de-energization of the coil 5, the armature 7 moves up and down. The vertical movement causes the armature 7 to collide with the core 4 or causes the needle 8 to collide with the valve seat 15; as a result, in some cases, the impact of the collision causes the travel members to bounce, whereby the amount of fuel injection cannot accurately be controlled.

In order to cope with the problem of bouncing, as illustrated in FIGS. 5 and 6, there is suggested a fuel injection valve in which the needle 8 and the armature 7 are separated from each other. In FIG. 5, the upstream end of the needle 8 penetrates the armature 7, and the front end of the needle 8 is fixed in a stopper 16 by means of welding or the like; on that occasion, an elastic member 17, such as a spring, is inserted between the stopper 16 and the armature 7, and the upper portion of the stopper 16 is pressed by the valve-closing spring 9 in such a way that the needle 8 and the armature 7 are pressed downstream. Because the existence of the elastic member 17 enables the armature 7 to travel in the axis direction by a predetermined amount with respect to the needle 8, an impact force caused by a collision is relaxed (e.g., refer to National Publication of International Patent Application No. 2002-506502).

Additionally, as is the case with the fuel injection valve illustrated in FIG. 5, the fuel injection valve illustrated in FIG. 6 is configured in such a way that the needle 8 and the armature 7 are separated; however, the fuel injection valve illustrated in FIG. 6 is further configured in such a way that, instead of inserting the elastic member 17, such as a spring, between the armature 7 and the stepped portion 19 of the needle 8, a predetermined gap is formed between the stepped portion 19 of the needle 8 and a bottom contact surface 21 of the armature 7 when the stopper 16 and a top contact surface 20 of the armature 7 make contact with each other.

Assuming that the armature 7 is attracted by the core 4 to collide with the core 4, the impact of the collision causes the armature 7 to rebound; however, the needle 8 tends to further travel toward the core 4, due to the inertia of its upward movement. In other words, although the respective directions of the energy of the armature 7 and the energy of the needle 8 are opposite to each other, the energy caused by the collision can be cancelled, by allowing the relative movement between the armature and the needle 8 by means of the gap between the stepped portion 19 of the needle 8 and the bottom contact surface 21 of the armature 7 (e.g., refer to Japanese Patent Laid-Open Pub. No. 2003-512557).

However, there has been a problem that the number of components and the number of processes considerably increase in such a structure, as disclosed in National Publication of International Patent Application No. 2002-506502, in which the armature 7 and the needle 8 are coupled with each other by means of the elastic member 17 such as a spring, whereby the structure becomes complex. Additionally, in the case of such a structure as disclosed in Japanese Patent Laid-Open Pub. No. 2003-512557, due to the existence of the gap between the stepped portion 19 of the needle 8 and the bottom contact surface 21 of the armature 7, the position of the armature 7 cannot be fixed; therefore, there has been a problem that the vibration of the internal combustion engine or the like causes the distance between the armature 7 and the core 4 to be unstable while the valve is closed, whereby the time required to open the valve fluctuates and the accuracy of an injection amount is deteriorated.

SUMMARY OF THE INVENTION

A fuel injection valve according to the present invention has been implemented in order to solve the foregoing problems; the objective thereof is to provide a fuel injection valve, in which, without increasing the number of components and the number of processes, bouncing of the needle can be suppressed, and by combining a preliminary energization technology with a conventional technology, the armature position at the timing immediately before the valve is opened is restricted, whereby the distance between the armature and the core can be maintained constant.

A fuel injection valve according to the present invention is characterized by including an armature that is repelled or attracted by a core, by de-energizing or energizing a coil; a needle that travels up and down in accordance with a reciprocal travel of the armature so as to open or close a valve seat; and a valve-closing spring that biases the needle so as to close the valve, when the coil is de-energized, and characterized in that the needle and the armature are fixed in such a way that the armature can travel in an axis direction by a predetermined amount with respect to the needle, and the coil is preliminarily energized while the fuel injection valve is closed by the needle.

According to the present invention, the responsiveness at the time when the valve is opened can be raised, and bouncing of the needle at the time when the valve is opened can be suppressed with a simple structure, without increasing the number of components; moreover, by restricting the position of the armature at the timing immediately before the valve is closed, thereby keeping the distance between the armature and the core constant, the time required for opening the valve is suppressed from fluctuating, whereby the accuracy of the linearity of an injection amount and the accuracy of an injection amount can be enhanced.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENT

Embodiment 1

Figure 6:
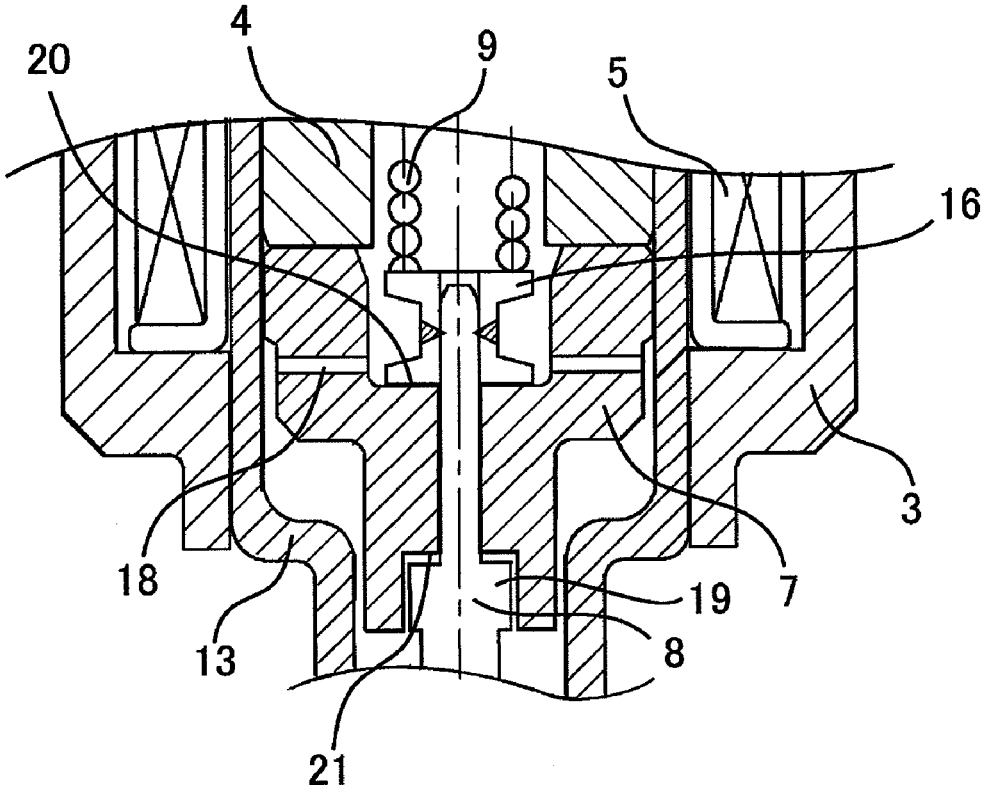
FIG. 6 is a partial enlarged configuration diagram illustrating further another embodiment of a conventional fuel injection valve.

Embodiment 1 of the present invention will be explained below. The configuration of a fuel injection valve 1 according to the present invention is the same in appearance as that illustrated in FIG. 6; therefore, Embodiment 1 will be explained with reference to FIG. 6. In FIG. 6, a stepped portion 19 is provided on the side surface of a needle 8, an armature 7 is put on the upstream side of the stepped portion 19 in such a way as to be penetrated by the needle 8, and the front end of the needle 8 is fixed in a stopper 16 by means of welding or the like in such a way that a stopper 16 and the stepped portion 19 flank the armature 7; on that occasion, the front end of the needle 8 is press-fitted and welded in the stopper 16, while the stopper 16 is adjusted in such a way that the armature 7 can travel by a predetermined amount with respect to the needle 8. Additionally, by making a valve-closing spring 9 make contact with the top end of the stopper 16, the armature 7 and, eventually, the needle 8 are pressed downstream so that the needle and a valve seat 15 perform a valve-closing operation. In addition, the armature 7 has a through-hole 18 as a fuel path; the through-hole 18 has a flow-path area large enough for an injection amount so that it does not become a flow-path neck portion.

The operation of the fuel injection valve 1 according to Embodiment 1 will be explained below with reference to FIGS. 2 and 3. FIG. 3 represents the values of an energizing current for a coil 5 at respective stages in the operation of a fuel injection valve illustrated in FIG. 2. First, FIG. 2(*a*) illustrates a valve-closing state in which the coil 5 is not energized; when the front end of the needle 8 is welded in the stopper 16, the distance between the armature 7 and the needle 8 is set in such a way that the armature 7 can travel in the axis direction by a predetermined amount with respect to the needle 8. Although the valve-closing spring 9 presses the stopper 16, the respective contact positions of an upstream contact surface 20 and a downstream contact surface 21 of the armature 7 are uncertain.

Figure 1:
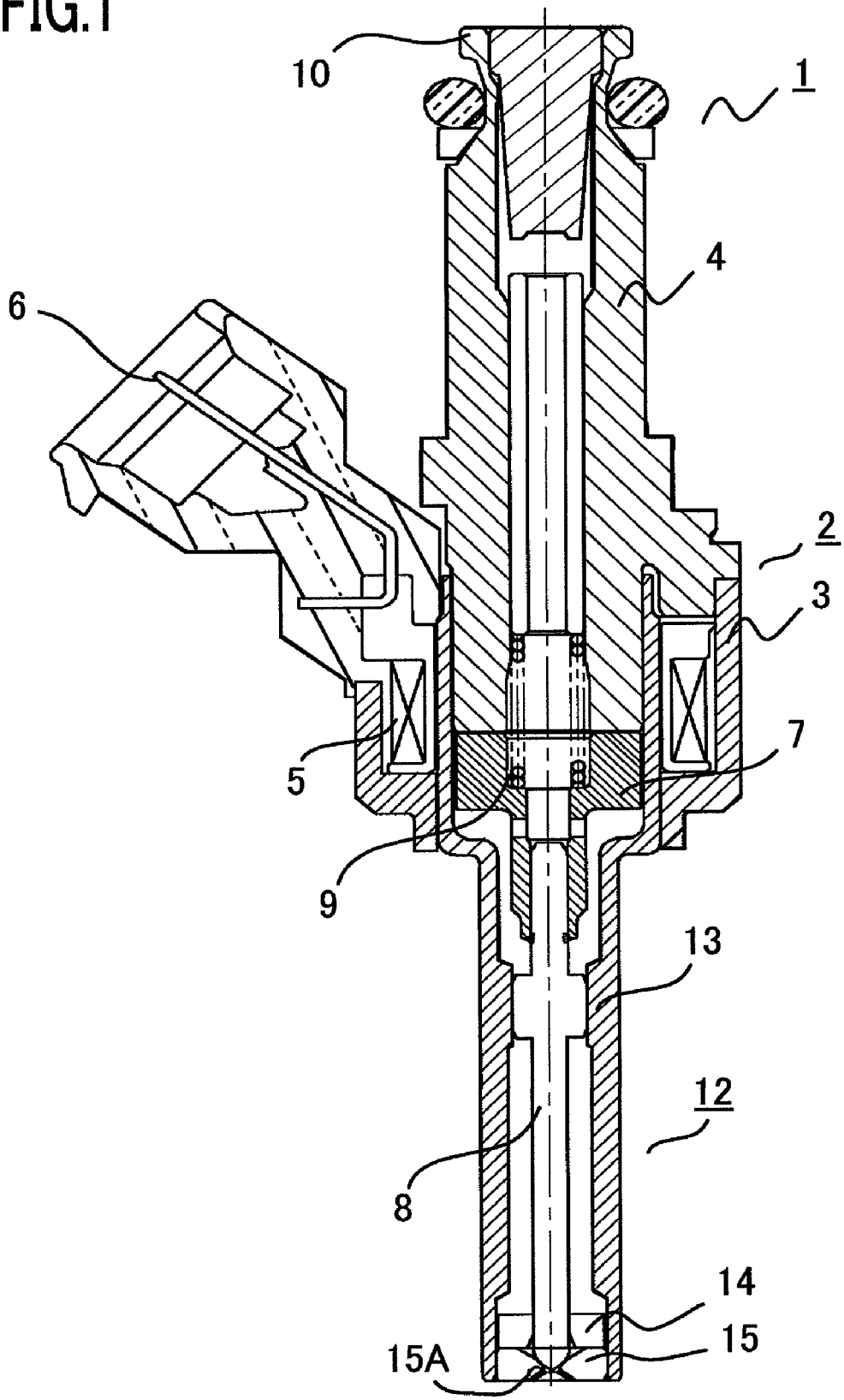
FIG. 1 is an overall schematic configuration diagram of a fuel injection valve for an internal combustion engine, according to the present invention.
Figure 2:
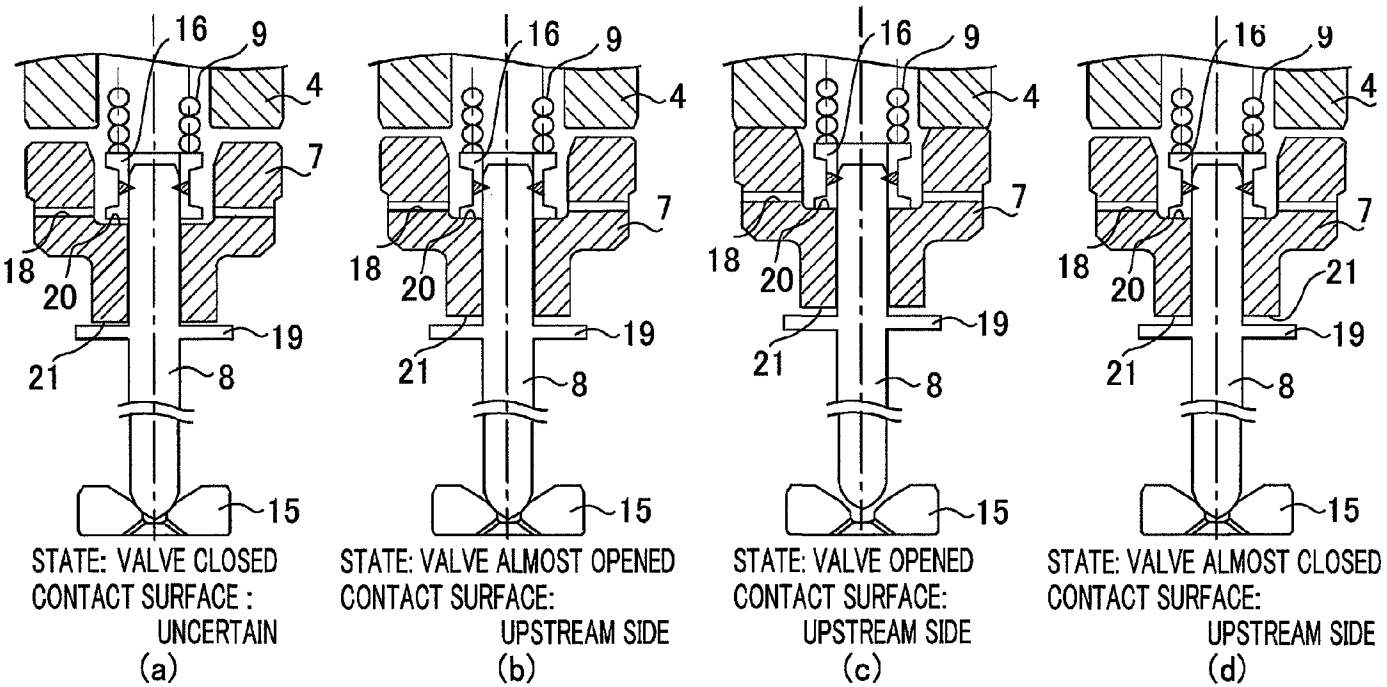
FIG. 2 is a set of diagrams for explaining the operation of a fuel injection valve according to Embodiment 1 of the present invention.
Figure 3:
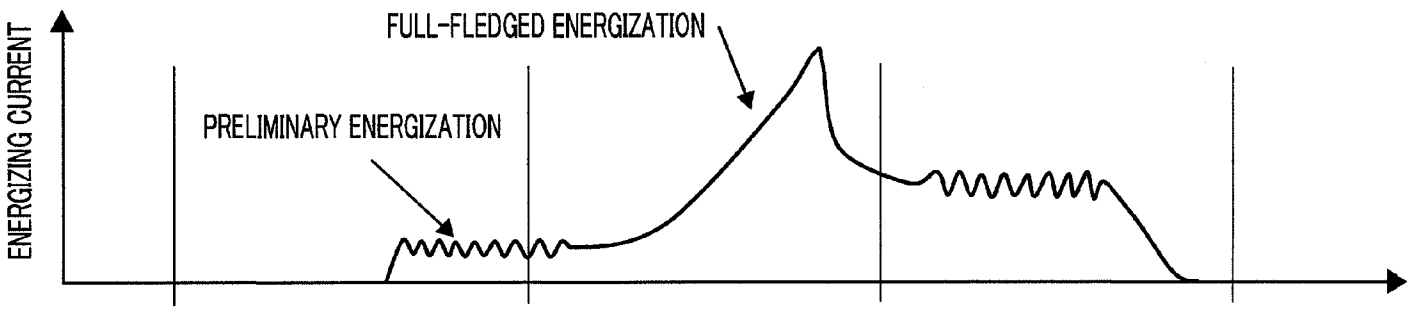
FIG. 3 is a chart representing an energizing current in a fuel injection valve according to Embodiment 1 of the present invention.
Figure 4:
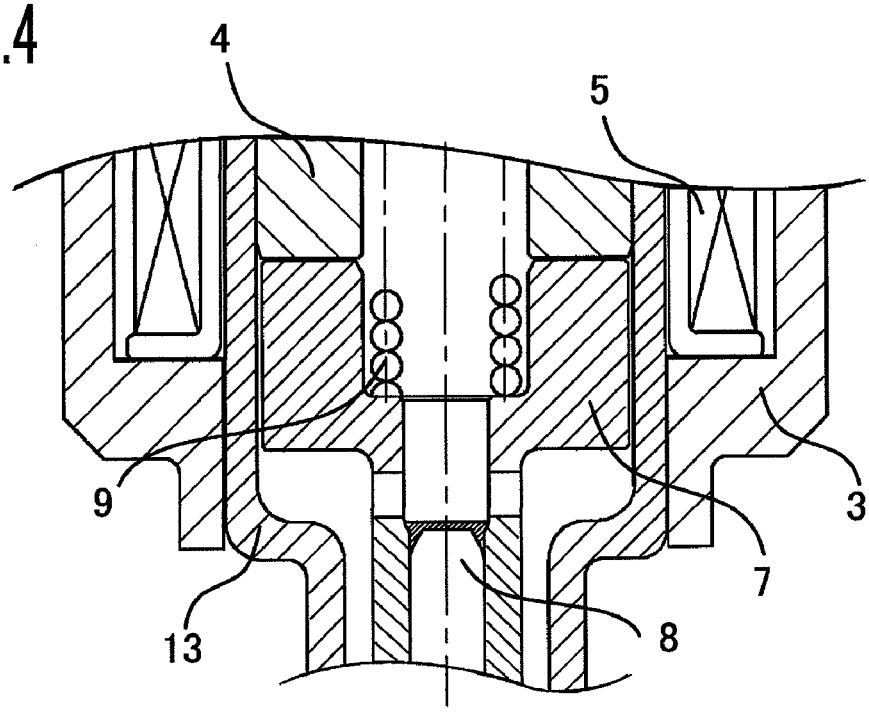
FIG. 4 is a partial enlarged configuration diagram illustrating an embodiment of a conventional fuel injection valve.
Figure 5:
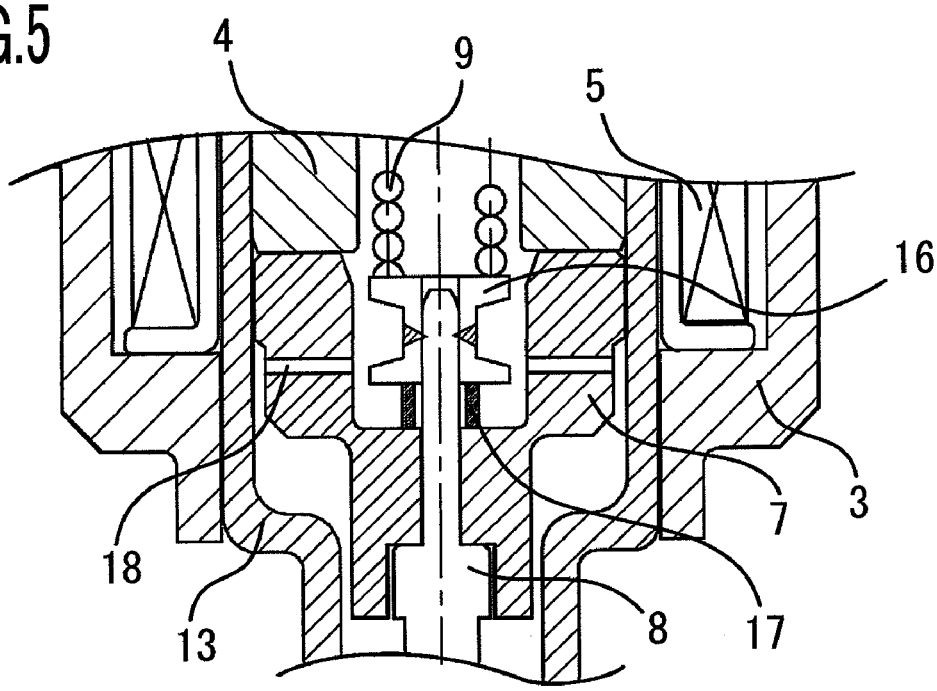
FIG. 5 is a partial enlarged configuration diagram illustrating another embodiment of a conventional fuel injection valve.

FIG. 2(*b*) illustrates a state in which, during a valve-closing period, preliminary energization (refer to FIG. 3) has been performed to the extent such that the needle 8 does not open the valve and the valve is almost opened. The armature 7 makes contact with the needle 8 at the upstream contact surface 20, so that the position of the armature 7 at the timing immediately before the valve is opened is fixed. As a result, an external vibration or the like is prevented from fluctuating the distance between the armature 7 and the core 4, whereby the time required for opening the valve can be kept constant. In addition, in the case of a fuel injection valve for injecting a fuel directly into a cylinder of an internal combustion engine, the amount of preliminary energization is required to be set to the extent such that the combustion-gas pressure does not cause the needle to open the valve.

FIG. 2(*c*) illustrates a state in which full-fledged energization is performed and the valve is opened; due to the full-fledged energization, valve-opening operation immediately advances from the state illustrated in FIG. 2(*b*), and the armature 7 and the core 4 collide with each other. When the collision occurs, the impact of the collision causes only the armature 7 to rebound downstream; in contrast, due to its inertial force, the needle 8 keeps moving and overshoots upstream. In this situation, when the sum of the amount of bouncing of the armature 7 and the amount of overshooting of the needle 8 becomes equal to the predetermined amount y by which the armature 7 can travel with respect to the needle 8, the armature 7 and the needle 8, having respective forces opposite to each other, collide with each other at the downstream contact surface 21, whereby the movement of the armature 7 and the movement of the needle 8 cancel each other; therefore, the needle 8 can be suppressed from bouncing when the valve is opened, whereby the accuracy of the linearity of an injection amount can be prevented from being deteriorated by the bouncing.

FIG. 2(*d*) illustrates a state in which energization has been interrupted again and the armature 7 is biased downstream by the valve-closing spring 9, i.e., a state at the timing immediately before the valve is closed. In this situation, even if there exists bouncing of the needle 8 caused by a collision between the needle 8 and the valve seat 15, because there exists the gap, between the downstream contact surface 21 of the armature 7 and the stepped portion 19, having the predetermined amount by which the armature 7 can travel with respect to the needle 8, the bouncing of the needle 8 and the inertial force exerted on the armature 7 cancel each other.

As can be seen from the foregoing explanation, in the fuel injection valve according to Embodiment 1 of the present invention, the bouncing of the needle 8 at the time when the valve is opened can be suppressed, without causing the number of components to increase. In particular, by preliminarily energizing the coil at the timing immediately before the valve is opened, the upstream contact surface 20 of the armature 7 makes contact with the needle 8, so that the position of the armature 7 at the timing immediately before the valve is opened can be fixed; therefore, an external vibration or the like is prevented from fluctuating the distance between the armature 7 and the core 4, whereby the time required for opening the valve can be kept constant and the responsiveness at the time when the valve is opened can be enhanced; therefore, the accuracy of an injection amount can eventually be enhanced.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve comprising: an armature that is repelled or attracted by a core, by de-energizing or energizing a coil;

a needle that travels up and down in accordance with a reciprocal travel of the armature so as to open or close a valve seat; and a valve-closing spring that biases the needle so as to close the valve, when the coil is de-energized, wherein the needle and the armature are fixed in such a way that the armature is operative to travel in an axis direction by a predetermined amount with respect to and independently of the needle so as to be movable between a contact position and a non-contact position with the needle, and the coil is preliminarily energized while the fuel injection valve is closed by the needle.

2. The fuel injection valve according to claim 1, wherein, in the case of a fuel injection valve for injecting a fuel directly into a cylinder of an internal combustion engine, the amount of preliminary energization is set to the extent such that a combustion-gas pressure does not cause the needle to open the valve.

* * * * *